US005168606A

United States Patent [19]

Ziemelis

[11] Patent Number: 5,168,606

[45] Date of Patent: Dec. 8, 1992

[54] JEWELRY CLASP WITH SAFETY SNAP CATCH

[75] Inventor: Herbert Ziemelis, Wallingford, Conn.

[73] Assignee: The Napier Company, Meriden, Conn.

[21] Appl. No.: 873,343

[22] Filed: Apr. 21, 1992

Related U.S. Application Data

[63] Continuation-in-part of Ser. No. 619,723, Nov. 29, 1990, abandoned.

[51] Int. Cl.[5] ..... F16G 15/00

[52] U.S. Cl. ..... 24/598.1; 24/116 A

[58] Field of Search ..... 24/695, 598.1, 116 R, 24/573.5, 600.1, 599.5, 601.5, 589

[56] References Cited

U.S. PATENT DOCUMENTS

| | | | |
|---|---|---|---|
| 1,007,213 | 10/1911 | Lau | 24/599.5 |
| 1,071,650 | 8/1913 | O'Kelly | 24/600.1 X |
| 1,442,043 | 1/1923 | Bosserman | 24/600.1 |
| 2,453,993 | 11/1948 | Kreisler | 24/598.1 |
| 3,168,768 | 2/1965 | Bohlinger et al. | 24/599.5 X |
| 4,774,743 | 10/1988 | Ziemelis | 24/598.1 |
| 4,790,148 | 12/1988 | Faini | 24/589 X |

*Primary Examiner*—James R. Brittain

*Attorney, Agent, or Firm*—Hayes & Reinsmith

[57] ABSTRACT

A jewelry clasp is provided featuring a safety catch for securing a cover after that cover is moved into a closed position on the base. The safety catch is mounted for swinging movement between the base and cover from a released position into a latched position wherein the free end of the safety catch releasably keeps the cover in its closed position.

25 Claims, 5 Drawing Sheets

JEWELRY CLASP WITH SAFETY SNAP CATCH

This is a continuation-in-part of copending application Ser. No. 07/619,723 filed on Nov. 29, 1990, abandoned.

FIELD OF THE INVENTION

This invention generally relates to jewelry clasps and more particularly concerns jewelry clasps of a type including a base and swinging cover supported on the base for movement between an opened position and a locked or closed position and having a safety catch to releasably keep the cover locked or closed.

BACKGROUND OF THE INVENTION

Jewelry clasps are used for interconnecting free ends of necklaces, chains, bracelets and similar type jewelry. To effect longer lasting usage, a variety of different approaches have been used as evidenced by the prior art. Normally, the locking of a jewelry clasp is delicate in nature and subject to seemingly incompatible objectives of providing security in a relatively small, aesthetically pleasing construction. An example of a clasp which has worked successfully is shown in U.S. Pat. No. 4,774,743 dated Oct. 4, 1988, entitled "Jewelry Clasp" and assigned to the assignee of this invention.

OBJECTS OF THE INVENTION

A principal object of this invention is to provide a new and improved jewelry clasp which is structurally and functionally superior to known clasps and which features a novel safety snap catch for securing the clasp in locked position. Related to this object is the aim of providing such a clasp which not only securely locks free ends of an attachable jewelry device but effects such a locking function in a clasp featuring simplicity of design and integrity of function which is significantly enhanced by the disclosed safety snap catch.

Another object of this invention is to provide a clasp with a catch of the above described type which is economical to manufacture, is comprised of a minimum number of parts and is quick and easy to use repeatedly and reliably over an extended period of time.

Other objects will be in part obvious and in part pointed out in more detail hereinafter.

SUMMARY OF THE INVENTION

A jewelry clasp is disclosed which comprises a base, a cover supported on the base for swinging movement, the base and cover having cooperating means for releasably securing the base and cover in locked or closed position, the cover having a free end movable from an opened position into said closed position wherein the free end of the cover is closed on the base, the base and cover in closed position jointly defining first and second attachable link aperture means for the clasp, and a safety catch cooperating with the base and cover and having a free end movable between the base and cover from a released position into a latched position for releasably keeping the cover in its closed position.

A better understanding of the objects, advantages, features, properties and relations of the invention will be obtained from the following detailed description and accompanying drawings which set forth certain illustrative embodiments and are indicative of the various ways in which the principle of this invention is employed.

DETAILED DESCRIPTION OF THE PREFERRED EMBODIMENTS

Figure 8:
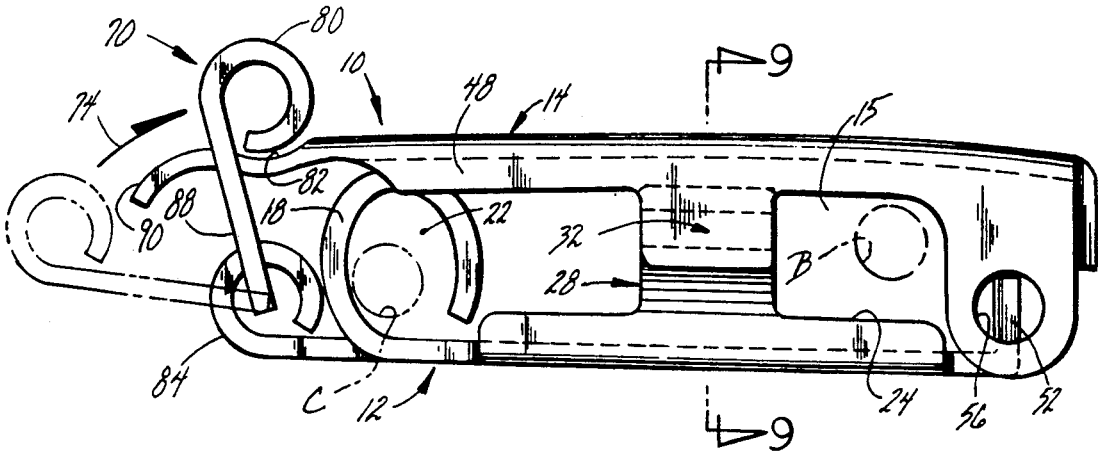
FIG. 8 is a side view showing the base and cover of the clasp of this invention in assembled, locked relation.

Referring in detail to the drawings, a jewelry clasp of this invention is generally described in the above referenced U.S. Pat. No. 4,774,743, the subject matter of which is herein incorporated by reference and made a part hereof. The clasp is indicated by numeral 10 and comprises an elongated base 12 and cover 14 wherein cover 14 is supported on base 12 for swinging movement about a pivot axis A between an opened position (not shown) and a locked or closed position (FIG. 8). In such locked position, clasp 10 will be understood to secure attachable free end links B and C of a jewelry device in first and second openings 15 and 22 (FIG. 8).

Base 12 includes a base plate 16 of generally rectangular configuration having a pair of coiled end portions or eyes 18, 18 at one end and a laterally extending crossbar 20 at an opposite end of plate 16. Eyes 18, 18 of base plate 16 form the above mentioned laterally extending openings 22, 22 which are in aligned concentric relation and receive a free end link C of a chain, necklace, bracelet or the like, not shown. The base plate 16 further includes a pair of upright side walls 24, 26 on opposite lateral sides of the plate 16 and upstanding resilient friction tongs 28, 30 which longitudinally extend (transversely to pivot axis A) and project upwardly midway along the length of each base side wall 24 and 26.

Figure 4:
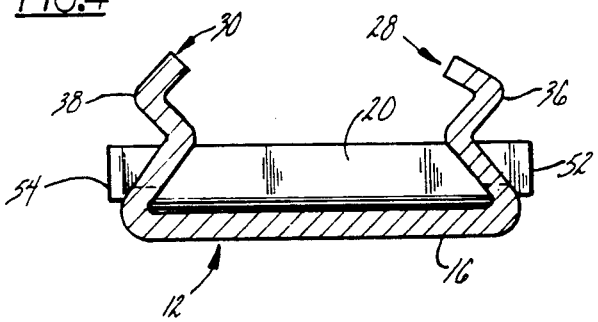
FIG. 4 is a cross-sectional view, taken generally along line 4—4 of FIG. 3.
Figure 5:
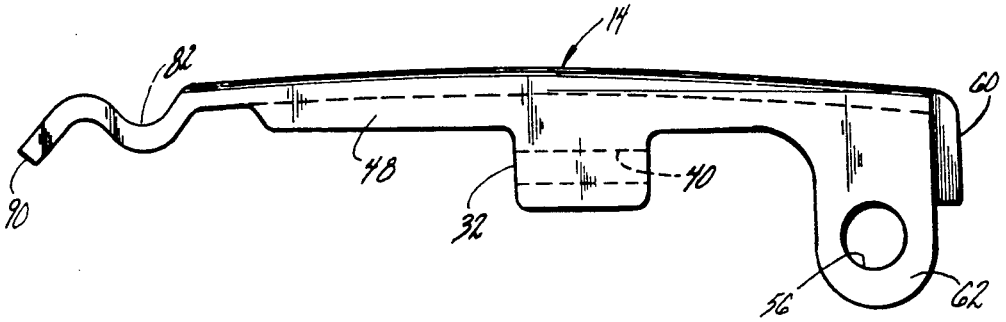
FIG. 5 is a side view of a cover of a clasp of this invention.
Figure 6:
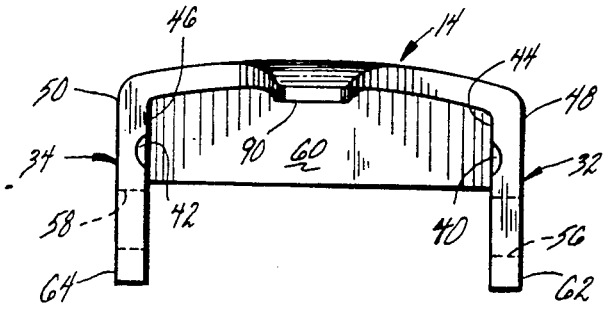
FIG. 6 is an end view of the cover of FIG. 5.
Figure 7:
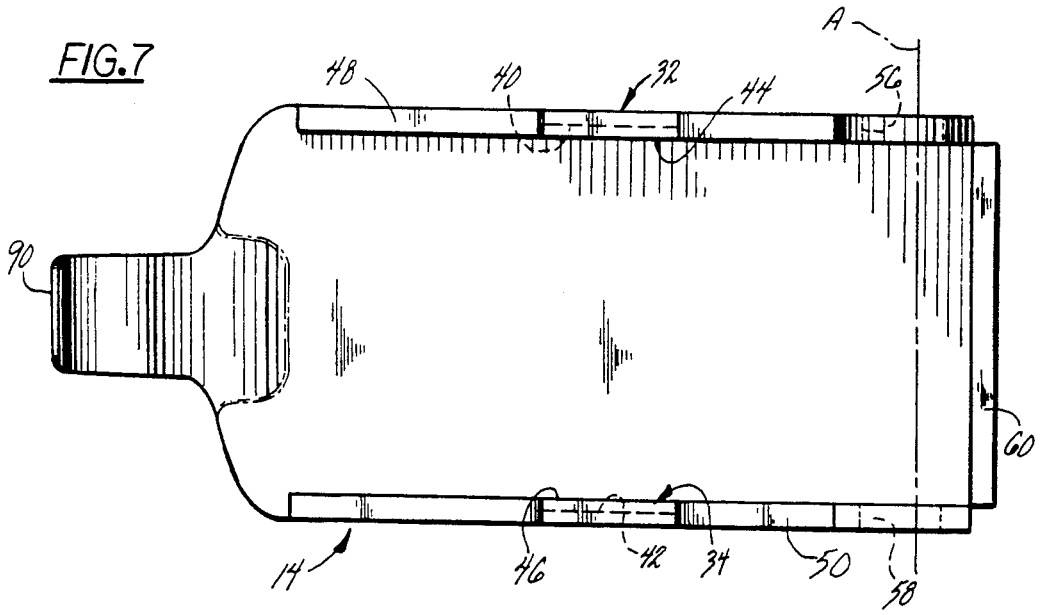
FIG. 7 is a bottom plan view of the cover of FIG. 5.
Figure 9:
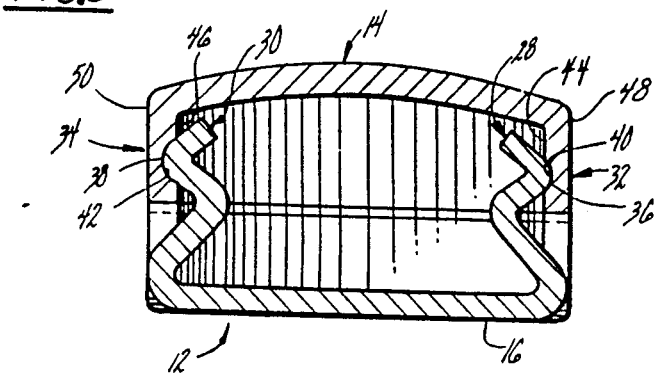
FIG. 9 is a cross-sectional view, taken generally along line 9—9 of FIG. 8, with certain parts deleted for purposes of clarity.

Each of the upstanding friction tongs 28, 30 is particularly suited to provide significantly increased surface-to-surface contact engagement with corresponding elongated friction tongs or flanges 32, 34 formed on the cover 14 and extending longitudinally thereof in transverse relation to pivot axis A. More specifically, friction tongs 28, 30 are each of serpentine or generally S-shaped cross-section in mirror-image relation to one another (FIGS. 4 and 9) and include an off-set shoulder 36, 38 formed by convex curved wall portions of the tongs 28, 30. Shoulders 36, 38 thus each provide for mating registration with a longitudinally extending, complementary recessed locking groove 40, 42 (FIG. 6) on an elongated inner face 44, 46 of each of the depending elongated resilient friction flanges 32, 34 extending downwardly from opposed side walls 48, 50 of the swinging cover 14. The longitudinally extending, recessed locking grooves 40, 42 are best seen in FIGS. 6 and 7. The inner face 44, 46 of each depending friction flange 32, 34 is particularly suited to fully engage the off-set shoulder 36, 38 (FIG. 9) of each friction tong 28, 30 when the base 12 and cover 14 are assembled and snapped into locked position (FIG. 8). Accordingly, the base 12 and cover 14 are each formed as relatively simple parts of one-piece construction, and significantly increased surface-to-surface area contact is obtained between the complementary base and cover tongs.

Base 12 includes a pair of fingers 52, 54 projecting in opposite lateral directions from ends of cross bar 20 and which jointly define pivot axis A for swinging cover 14 upon mounting fingers 52, 54 in mating openings 56, 58 respectively formed in a pair of ears 62, 64 depending from cover 14 adjacent its end wall 60.

Figure 1:
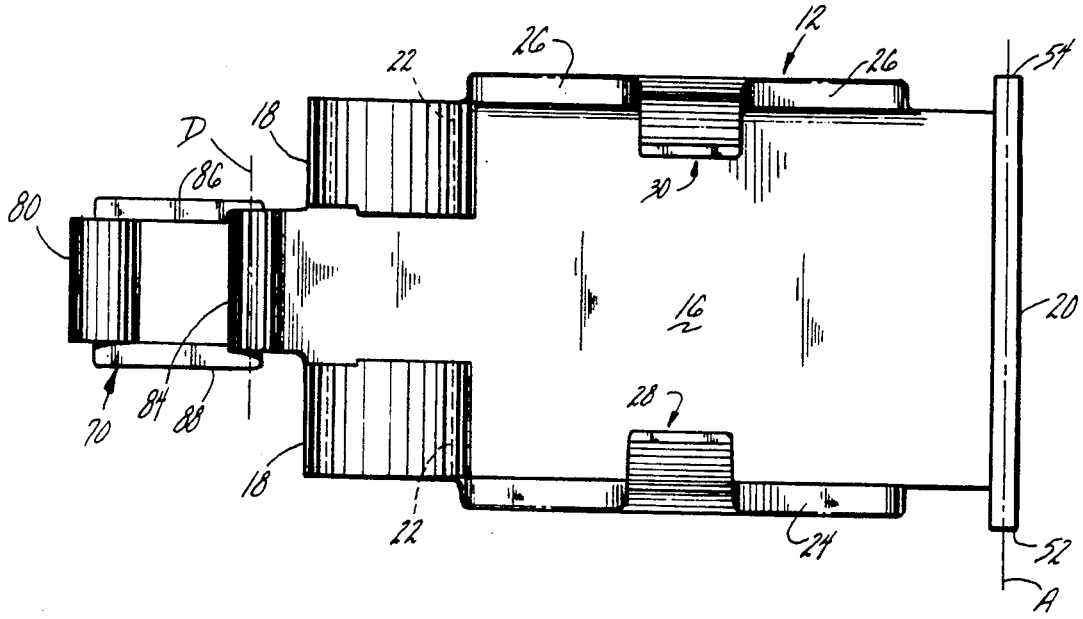
FIG. 1 is a plan view of a base of a clasp of this invention.
Figure 2:
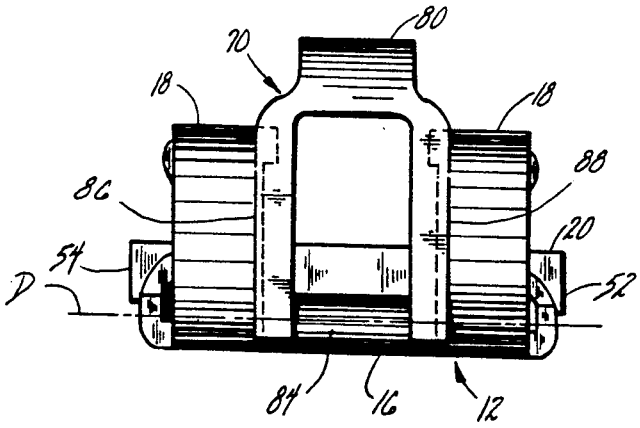
FIG. 2 is an end view of the base of FIG. 1.
Figure 3:
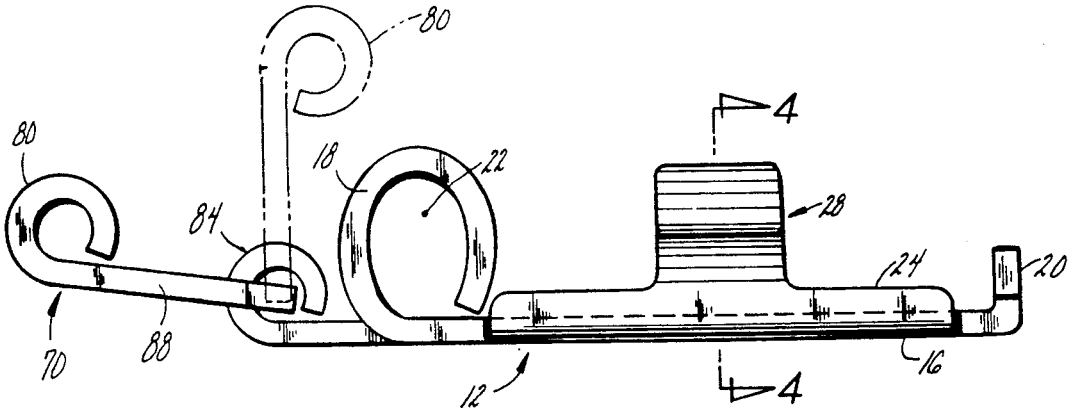
FIG. 3 is a side view of the base of FIG. 1.
Figure 10:
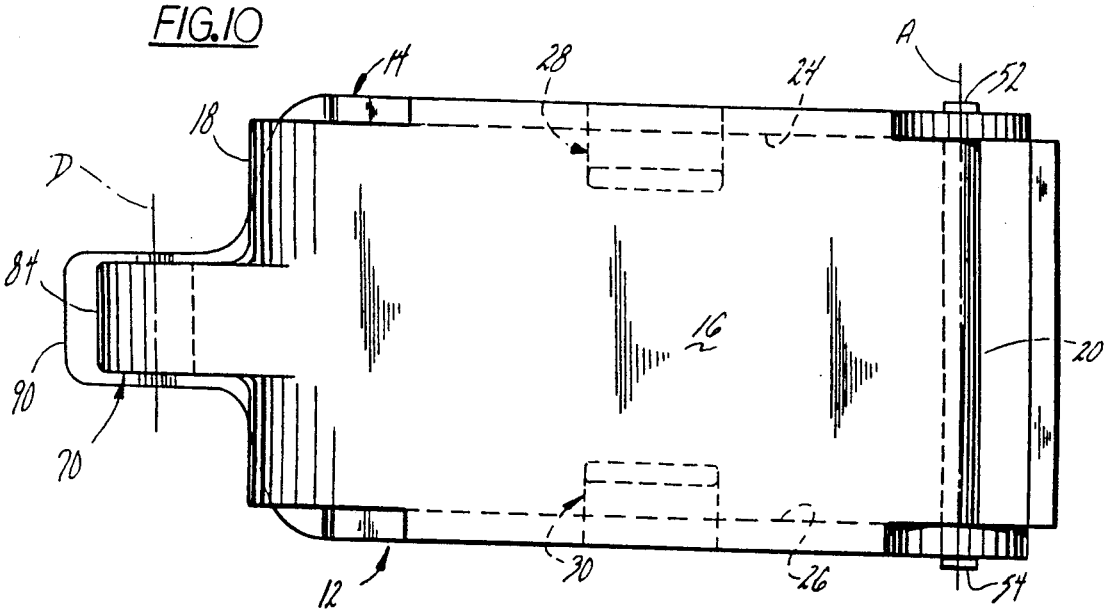
FIG. 10 is a bottom plan view of the assembled clasp of FIG. 8.

In accordance with this invention, clasp 10 additionally includes a safety snap catch 70 which significantly enhances the structural integrity of the clasp and its locking effectiveness. For releasably keeping the cover 14 in its locked position (FIG. 8) on base 12, catch 70 is shown supported on base 12 for swinging movement about a second pivot axis D in spaced parallel relation to pivot axis A (FIGS. 1 and 10) with the catch 70 having a free swinging end movable in an angular direction as depicted by arrow 74 (FIG. 8) from a released position (shown in dotted lines in FIG. 8) into a latched position (shown in full lines in FIG. 8) wherein the free swinging end of catch 70 is folded onto cover 14 in its illustrated locked position. The free end of catch 70 is integrally formed in a coil to provide a latch 80, and a cavity or recess 82 is provided in cover 14 adjacent its swinging free end for receiving latch 80 of catch 70 to engage the coiled free end of catch 70 in a snapping action onto cover 14.

In the specifically illustrated embodiment, base plate 16 includes a projecting coiled extension 84 disposed between coiled eyes 18, 18 in longitudinally spaced parallel relation thereto. For supporting the latch 80 of catch 70 for swinging movement between its released position and its latched position, a pair of spaced parallel legs 86, 88 are provided with feet (not shown) turned inwardly toward one another within extension 84 for mounting the catch 70 on base 12 for swinging movement about pivot axis D, with the legs 86, 88 connected opposite their feet to latch 80.

Figure 11:
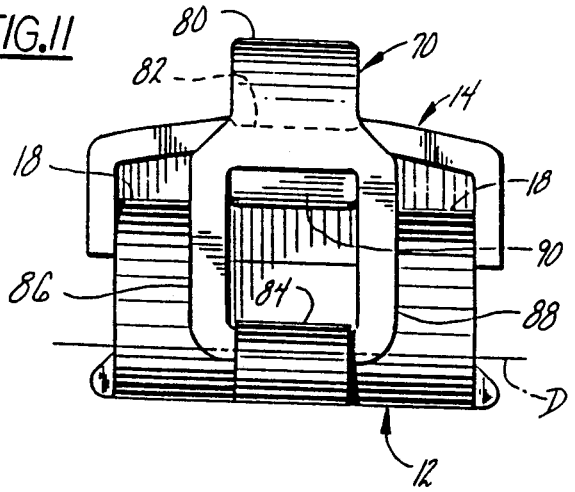
FIG. 11 is an end view of the clasp of this invention in assembled, locked relation.

To facilitate release of cover 14 from locked position on base 12 when catch 70 is in released position, cover 14 is shown provided with a projecting tongue 90 which, in the locked position (FIGS. 8 and 11) of cover 14, is disposed between legs 86, 88 of catch 70 and below its latch 80 when catch 70 is in its latched position. Tongue 90 is readily pried upwardly by a user's thumb nail or fingernail to release cover 14 from locked position when said catch 70 is in released position.

It is to be understood that the clasp 10 in its entirety, including catch 70, is preferably formed of a suitable resilient metal material to effect releasable snap engagement not only of the cover 14 onto base 12 but also of the coiled free end latch 80 of catch 70 in its latched position onto cover 14 in its locked position.

Figure 12:
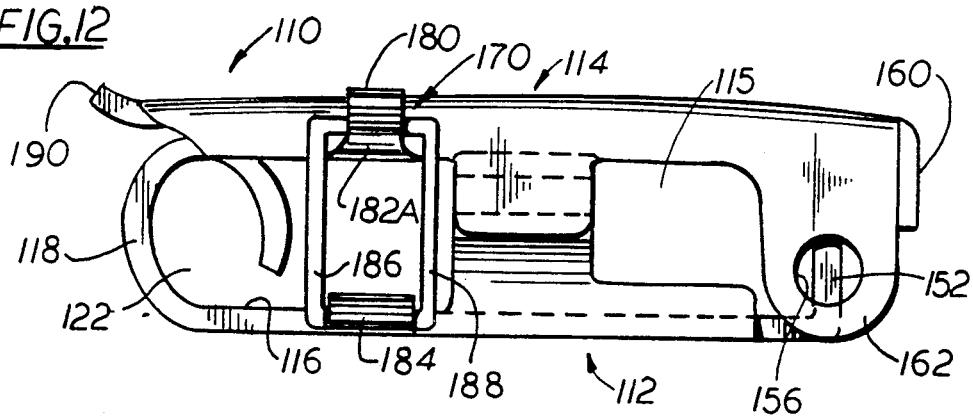
FIG. 12 is a side view showing the base and cover of another embodiment of this invention in assembled, closed relation.
Figure 13:
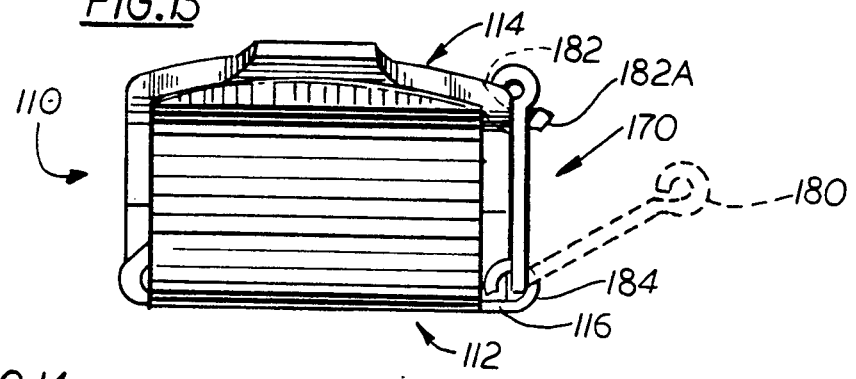
FIG. 13 is an end view of the clasp of FIG. 12 in assembled, closed relation.

Referring now to an embodiment of the invention illustrated in FIGS. 12 and 13, the same numbers increased by 100 are used to identify elements of FIGS. 12 and 13 corresponding to those described in the embodiment of FIGS. 1–11.

Clasp 110 will be understood to comprise an elongated, generally rectangular base 112 and cover 114, as previously described, wherein cover 114 is supported on base 112 for swinging movement about a pivot axis defined by fingers such as at 152 received in openings such as at 156 formed in ear 162 depending from cover 114 adjacent its end wall 160. An end of base 112 opposite its fingers 152 is shown having a coiled end 118 defining an attachable link aperture means or opening 122. Another attachable link aperture means or opening 115 is shown located adjacent an end of base plate 116 on which cover 114 is supported for swinging movement. To release cover 114 from its closed position on base 112 as illustrated, cover 114 has a projecting tongue 190 which can be quickly and easily manipulated manually, as described in the first embodiment, to move cover 114 into released position, not shown, in remotely spaced relation to coiled end 118 of base 112.

Turning now to the catch of this embodiment, catch 170 is shown supported on a side of base 112 for swinging movement about a second pivot axis which will be understood to extend in perpendicular relation to a first pivot axis defined by fingers 152 of base 112. The second pivot axis is located in underlying relation to a cavity or recess 182 provided in cover 114 when cover 114 is in its illustrated closed position. Recess 182 will be understood to be in the form of a groove defined by an arcuate projection 182A extending longitudinally along a side edge of cover 114 for receiving a free end of catch 170 in its latched position illustrated in full lines in FIGS. 12 and 13. In this specifically illustrated embodiment, the free end of safety catch 170 is in the shape of a coil to define a latch 180 which has a pair of spaced parallel legs 186, 188 on opposite sides of projection 182A interconnecting and pivotally mounting the latch 180 to the base 112, it being understood that each of the legs has an inwardly turned foot (not shown) each extending toward the other and received within the confines of a coiled side extension 184 on a side edge of base plate 116.

Accordingly, it will be seen that cover 114 may be quickly and easily secured in its closed position on base 112 by means of catch 170. The free swinging end of latch 180 readily moves from released position (shown in broken lines in FIG. 13) into its full line latched position wherein catch 170 is folded onto cover 114 in its illustrated closed position with latch 180 secured in recess 182 in cover 114 in a snap action manual maneuver securing catch 170 onto cover 114.

It will be understood that cover 114 and base 112 each have suitable tongs, not shown, integrally formed on their respective members with the cover tongs disposed in underlying relation to the cover 114 and the base tongs in upstanding relation to the base 112 and registrable with the corresponding cover tongs in direct surface-to-surface area contact for releasably securing the base 112 and cover 114 in closed position.

Thereafter, when it is desired to open clasp 110, catch 170 may be readily released, and tongue 190 of cover 114 may be quickly and easily manipulated to move cover 114 into its opened position relative to base 112.

Figure 14:
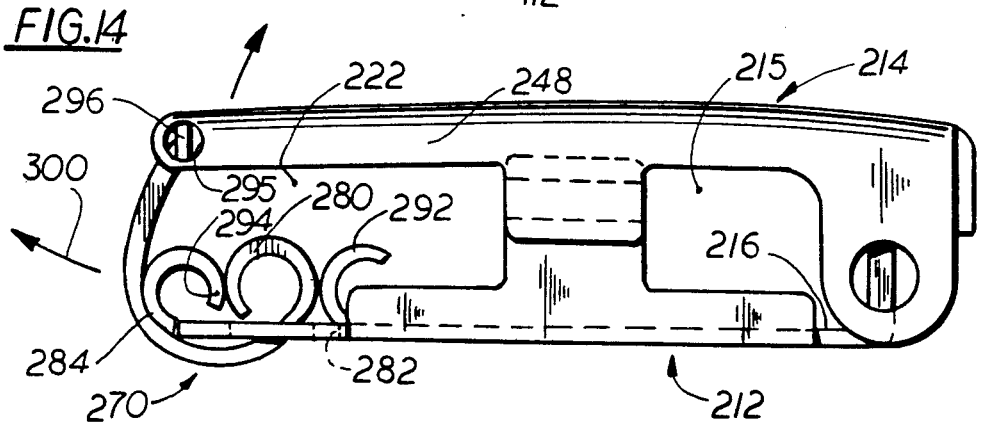
FIG. 14 is a side view showing the base and cover of yet another embodiment of this invention in assembled, closed relation.
Figure 15:
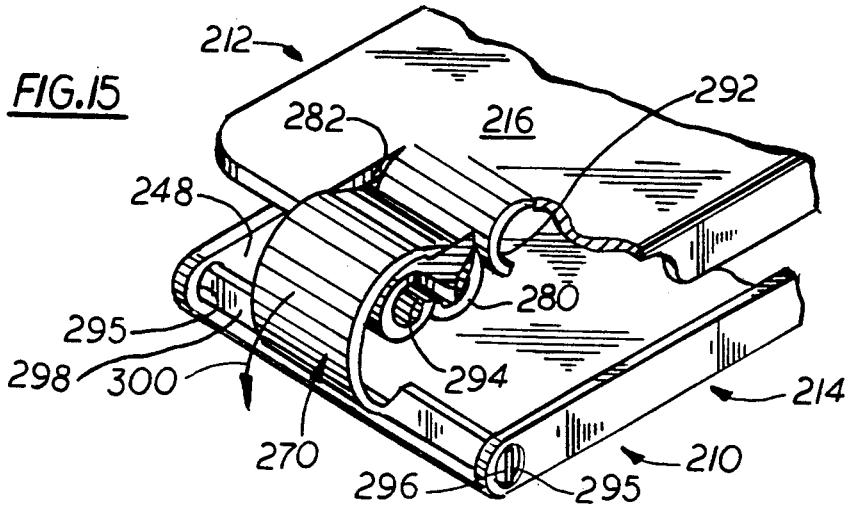
FIG. 15 is a bottom perspective view, partly broken away, of the clasp of FIG. 14 in assembled, closed relation.

Turning now to FIGS. 14 and 15, the elements of the embodiment of this invention, are identified by the same numbers, increased by 200, used to denote like elements of the embodiment of FIGS. 1-11. A clasp 210 is illustrated wherein its cover 214 and base 212 are of similar construction to that described in the previous embodiments wherein the base 212 and cover 214 in closed position jointly define first and second openings 215 and 222 for securing free end links, not shown, of an attachable jewelry device adjacent one end of base plate 216 on which cover 214 is supported for swinging movement and at an opposite end of the base plate 216 in underlying relation to a free end of cover 214 in closed position. As in the previously described embodiments, the base 212 and cover 214 will be understood to have a pair of tongs, not shown, formed on each of the base and cover members which are interengageable for securing the base 212 and cover 214 in assembled, closed position.

To secure catch 270, the preferred form of this embodiment is shown having a catch-receiving cavity or opening 282 centrally formed adjacent an end of base plate 216 opposite its end on which cover 214 is pivotally mounted. That opening 282 extends between an inwardly turned lip 292, integrally and centrally formed in base plate 216, and a reversely turned end 294 of a centrally located coiled extension 284 of base plate 216. Extension 284 is integrally attached to opposite sides of base plate 216 in spaced opposed relation to lip 292. The free end of cover 214 is illustrated as having a pair of end apertures 295, 295 for receiving projecting fingers such as at 296 of a cross bar 298 (FIG. 15) of catch 270 extending between opposed side walls 248, 250 of the swinging cover 214.

To secure cover 214 in its closed position on base 212, catch 270 is shown integrally formed with cross bar 298 and is shown having a latch 280 defined by a coiled end which is moved in a counter-clockwise direction as viewed in FIG. 14 into a latched position, as illustrated when cover 214 is in its closed position, wherein latch 280 is secured within the catch-receiving opening 282 in engagement with lip 292 and coiled extension 284 of base plate 216. Prior to releasing cover 214 from its closed position, the safety catch 270 may be manipulated to withdraw latch 280 from its catch-receiving opening 282 in the direction depicted by arrow 300 as viewed in FIGS. 14 and 15.

From the above description, it will be seen that the described clasp and its catch provide not only enhanced structural integrity and locking effectiveness, but such desired functions are provided in a design suited for minimizing the cost of manufacture and optimizing wearability and reliable usage over an extended period of time.

As will be apparent to persons skilled in the art, various modifications, adaptations and variations of the foregoing specific disclosure can be made without departing from the teachings of this invention.

I claim:

1. A jewelry clasp comprising a base, a cover supported on the base for swinging movement, the base and cover having cooperating means for releasably securing the base and cover in closed position, the cover having a free end movable toward the base from an opened position into said closed position wherein the free end of the cover is closed on the base, the base and cover in closed position jointly defining first and second attachable link aperture means for the clasp, and a safety catch cooperating with the base and the cover and having a free end movable between the base and cover from a released position into a latched position for releasably keeping the cover in its closed position with its free end closed on the base.

2. The clasp of claim 1 wherein the safety catch is supported on the base for swinging movement toward and away from the cover between its latched and released positions, wherein the free end of the safety catch is formed to define a latch, and wherein the cover includes a recess therein for receiving the latch in said latched position of the safety catch.

3. The clasp of claim 2 wherein the cover is supported on the base for swinging movement about a first pivot axis, wherein the recess is formed in the cover adjacent its free end, and wherein the catch is supported at an end of the base for swinging movement about a second pivot axis in spaced parallel relation to said first pivot axis toward and away from said free end of the cover in its closed position.

4. The clasp of claim 2 wherein the cover is supported on the base for swinging movement about a first pivot axis, wherein the recess is formed in the cover adjacent one of its sides, and wherein the catch is supported on a side of the base for swinging movement about a second pivot axis, the second pivot axis extending in perpendicular relation to said first pivot axis and being located in underlying relation to the recess when the cover is in its closed position.

5. The clasp of claim 4 wherein the latch of the catch in its latched position is adjacent the free end of the cover in non-interfering relation to said attachable link aperture means.

6. The clasp of claim 1 wherein the cover includes a recess therein, and wherein the free end of the safety catch is coiled and is formed of a suitable resilient material to effect releasable snap engagement of the coiled free end of the safety catch onto the cover.

7. The clasp of claim 1 wherein the cover includes a projecting tongue formed on its free end, the tongue serving to facilitate manual manipulation of the cover from its closed position to its opened position when the safety catch is in its released position.

8. The clasp of claim 1 wherein the base includes an elongated rectangular plate having a cross bar in upstanding relation to the plate and extending laterally across the plate at one of its ends, the ends of the cross bar having projecting fingers extending in opposite directions and defining a pivot axis about which the cover is supported for swinging movement, and wherein the cover includes depending apertured ears defining openings for receiving the projecting fingers of the base plate and supporting the cover for swinging movement about said pivot axis between the opened position of the cover and its closed position.

9. The clasp of claim 1 wherein said cooperating means of the base and the cover comprises a pair of tongs formed on each of the base and cover members, the tongs of each member being interengageable with the tongs of the other member.

10. The clasp of claim 9 wherein the cover tongs each are integrally formed with the cover and are disposed in underlying relation to the cover, the base tongs each being integrally formed on the base in upstanding relation thereto and registrable with the corresponding cover tong in direct surface-to-surface area contact therewith for releasably securing the base and cover in said closed position.

11. The clasp of claim 1 wherein one of the cover and base members includes a catch-receiving cavity therein, and wherein the safety catch is pivotally mounted on the other of the cover and base members.

12. The clasp of claim 11 wherein the free end of the safety catch is coiled to define a latch and is formed of a suitable resilient material to effect releasable snap engagement of the coiled latch of the safety catch into said catch-receiving cavity.

13. The clasp of claim 1 wherein the safety catch is supported on the cover for swinging movement toward and away from the base between said catch latched and released positions.

14. The clasp of claim 13 wherein the free end of the safety catch is formed to define a latch, and wherein the base includes an opening therein for receiving the latch of the safety catch in its latched position.

15. The clasp of claim 13 wherein the cover is supported on the base for swinging movement about a first pivot axis, wherein the safety catch is pivotally supported on the free end of the cover for swinging movement about a second pivot axis in spaced parallel relation to said first pivot axis, and wherein the base includes an opening therein forming a cavity underlying the free end of the cover in its closed position for receiving the catch in its latched position.

16. The clasp of claim 1 wherein the base and cover each includes an elongated plate, and wherein the base and cover in said closed position jointly define said first and second attachable link aperture means, said first attachable link aperture means being located adjacent one end of the base plate on which the cover is supported for swinging movement, said second attachable link aperture means being located at an end of the base plate opposite its said one end.

17. The clasp of claim 16 wherein said opposite end of the base plate is formed with a coiled end defining said second attachable link aperture means.

18. The clasp of claim 17 wherein said coiled end of the base plate comprises concentric coiled end portions in side-by-side spaced relation providing aligned openings jointly defining said second attachable link aperture means for the clasp.

19. The clasp of claim 18 wherein said opposite end of the base plate includes a projecting coiled extension disposed between said coiled end portions and in longitudinally spaced parallel relation thereto, and wherein the safety catch has pivot means thereon mounted within the projecting coiled extension of the base plate and defining a pivot axis for supporting the free end of the safety catch for swinging movement between its released position and its latched position.

20. The clasp of claim 1 wherein the safety catch includes a pair of spaced parallel legs pivotally mounted on the base for swinging movement.

21. The clasp of claim 20 wherein the cover includes a projecting tongue formed on its free end, the tongue of the cover in its closed position being disposed between said legs of the catch and under its free end when the catch is in its latched position.

22. A jewelry clasp comprising a base including an elongate plate, a cover supported on the base for swinging movement about a first pivot axis, the base and cover having cooperating locking means for releasably securing the base and cover in locked position, the base and cover in locked position jointly defining a first attachable link aperture means adjacent one end of the base plate, an opposite end of the base plate being formed with a pair of concentric coiled end portions in side-by-side spaced relation providing a pair of aligned openings jointly defining a second attachable link aperture means for the clasp, the cover having a free end movable in one angular direction from an opened position into said locked position wherein the free end of the cover is closed on the base, and a safety catch supported on the base for swinging movement about a second pivot axis in spaced parallel relation to said first pivot axis, the safety catch having a free end movable in an angular direction opposite said one angular direction from a released position into a latched position wherein the free end of the safety catch is folded onto the cover in its locked position for releasably keeping the cover in its locked position.

23. The clasp of claim 22 wherein said opposite end of the base plate includes a projecting coiled extension disposed between said pair of coiled end portions and in longitudinally spaced parallel relation thereto, and wherein the safety catch has pivot means thereon mounted within the projecting coiled extension of the base plate for defining said second pivot axis for supporting the free end of the safety catch for swinging movement between its released position and its latched position.

24. A jewelry clasp comprising a base, a cover supported on the base for swinging movement about a first pivot axis, the base and cover having cooperating locking means for releasably securing the base and cover in locked position, the cover having a free end movable in one angular direction from an opened position into said locked position wherein the free end of the cover is closed on the base, and a safety catch supported on the base for swinging movement about a second pivot axis in spaced parallel relation to said first pivot axis, the safety catch having a free end movable in an angular direction opposite said one angular direction from a released position into a latched position wherein the free end of the safety catch is folded onto the cover in its locked position for releasably keeping the cover in its locked position, the cover including a projecting tongue formed on its free end, the tongue serving to facilitate manual manipulation of the cover from its locked position to its opened position when the safety catch is in its released position, the safety catch including a pair of spaced parallel legs mounted on the base for swinging movement about said second pivot axis and connected to the free end of the catch, the tongue of the cover in its locked position being disposed between said legs of the catch and under its free end when the catch is in its latched position.

25. The clasp of claim 24 wherein the cover includes a recess therein adjacent its free end, wherein the free end of the safety catch is coiled and is formed of a suitable resilient material to effect releasable snap engagement of the coiled free end of the safety catch in its latched position onto the cover in its locked position.

* * * * *